US005511707A

United States Patent [19]

Reichert

[11] Patent Number: 5,511,707

[45] Date of Patent: Apr. 30, 1996

[54] BOX HOLDER AND CARRIER

[76] Inventor: Greg Reichert, 1655 Buckingham Rd., Teaneck, N.J. 07666

[21] Appl. No.: 376,940

[22] Filed: Jan. 23, 1995

[51] Int. Cl.[6] ..... A45F 5/00

[52] U.S. Cl. ..... 224/270; 224/226; 224/242

[58] Field of Search ..... 200/224, 225, 200/226, 242, 259, 260, 261, 262, 268, 270, 149, 902, 904, 908, 925

[56] References Cited

U.S. PATENT DOCUMENTS

| | | | |
|---|---|---|---|
| 2,651,441 | 9/1953 | Rau et al. | 224/259 |
| 4,319,704 | 3/1982 | Rosen | 224/270 |
| 4,779,777 | 10/1988 | Johnson et al. | 224/904 |
| 4,901,898 | 2/1990 | Colombo et al. | 224/270 |

*Primary Examiner*—Henry J. Recla
*Attorney, Agent, or Firm*—Donald R. Heiner

[57] ABSTRACT

The invention relates to a device used to assist a person in carrying heavy, bulky, box-like objects having essentially square corners. The device is attached to the person such as buy attachment to a belt or pants or the like. The device is preferably of one piece construction having a vertical and horizontal portion. The vertical portion has a metal clip or the like for attachment to the person and a horizontal or shelf like portion extends outwardly at approximately 90 degrees from the vertical portion and has a 90 degree or "V" notch formed therein into which a corner of a box-like structure is placed for carrying and thereby limiting the load on the hands and arms of the person carrying the object.

4 Claims, 1 Drawing Sheet

BOX HOLDER AND CARRIER

BACKGROUND OF INVENTION

1. Field of the Invention

The present invention generally involves the field of technology pertaining to a device to assist in holding and carrying heavy, bulky, box-like objects such as boxes of tiles or the like carried by persons, for instance, at construction job sites thereby freeing the persons arms and hands to better balance the box or for opening doors or pushing elevator buttons, etc.

In general, the device comprises a horizontal and vertical portion spaced approximately 90 degrees apart and usually of one piece construction. The vertical portion fits adjacent to the person carrying the device and has a spring loaded clip or the like for attachment to the persons belt or pants for securing the box holder and carrier to the user. Extending outwardly of the person, at approximately 90 degrees to the vertical portion, is a horizontal or shelf-like portion which accommodates and holds the corner of a box. A "V" shaped notch is formed in the horizontal or shelf-like portion for accommodating a corner of the box.

Disposed on either side of the spring loaded clip on the vertical portion of the device are dense soft rubber molded pads for cushioning the device against the user when a heavy box is loaded into the "V" shaped notch.

Preferably the upper surfaces of the horizontal portion of the device have non-slip rubber coatings.

2. Description of the Prior Art

A search of the prior art has uncovered Seber U.S. Pat No. 4,821,933; Anderson, U.S. Pat. No. 4,819,847; Vorsanger, et al., U.S. Pat. No. 4,223,820; Pattermann, U.S. Pat. No. 4,307,825; and, Jasper, U.S. Pat. No. 2,658,650.

The Seber patent, U.S. Pat. No. 4,821,933 is seen as disclosing a tape rule holder for mounting to a worker's belt and having the front piece bowed outwarded to form a tape rule pocket. The Anderson patent, U.S. Pat. No. 4,819,847 discloses a carpenter's tool holder adapted to hold a carpenter's speed square onto a wearer's belt. The holding portion is configured from a single strip of metal configured to form a generally triangular-shaped member. The Vorsanger, et al., U.S. Pat. No. 4,223,820 patent discloses a holder for a triangular carpenter's square wherein the holder has alternative closures and belt attachment devices. The patent to Pattermann, U.S. Pat. No. 4,307,825 discloses a bricklayer's trowel holster wherein "the pocket is V-shaped with an inclined edge along its upper opening so as to serve in orienting the tool in the holster. The patent to Jasper, U.S. Pat. No. 2,658,650 discloses a fishing rod holder.

None of these references discussed above have a vertical and horizontal portion spaced 90 degrees apart and wherein the horizontal portion contains a "V" notch for accommodating the edge of a heavy box-like structure.

SUMMARY OF THE INVENTION

The present invention relates to a holder and carrier for heavy box-like objects such as may be transported especially at construction sites and which may contain floor tiles, linoleum squares, etc. The device of the instant invention assists the person carrying such heavy box-like structures and can be worn around the waist of the person such as by attachment to a belt, pants, etc. When worn by the person a shelf extends outwardly, horizontally from the the person and contains a "V" shaped notch into which the edges of a box can be held when such box is located approximately 45 degrees from the vertical. The weight of such heavy box-like structure is then distributed to the torso of the person thereby greatly relieving the weight on the hands and arms.

It is therefore an object of the present invention to provide a device to be worn by a person for assisting in the carrying of a box-like object.

It is another object of the invention to provide a box holder and carrier comprising a vertical portion to be worn adjacent to a person and wherein such vertical portion further comprises a spring loaded clip for attachment to the belt of the person.

It is a further object of the invention to provide such a box holder and carrier wherein the device further comprises a horizontal or shelf-like portion disposed approximately 90 degrees from the vertical portion wherein the horizontal portion acts as a shelf for holding a heavy box-like structure.

It is still a further object of the invention to provide such a box holder and carrier wherein the horizontal or shelf-like portion has a "V" shaped notch formed therein into which a box-like structure fits for holding and supporting the box.

These and other objects, features and advantages of the invention shall become apparent from the following detailed description of a preferred embodiment thereof and taken in conjunction with the drawings wherein like reference characters refer to corresponding parts in the several views.

DETAILED DESCRIPTION OF THE PREFERRED EMBODIMENT

A device used to assist a person in carrying heavy, bulky, box-like objects and having essentially square corners, and attached to the person and having a vertical and horizontal portion wherein the horizontal portion is a shelf containing a "V" shaped notch for accommodating and holding the box-like object will now be described in reference to FIGS. 1–4 of the drawings.

Figure 1:
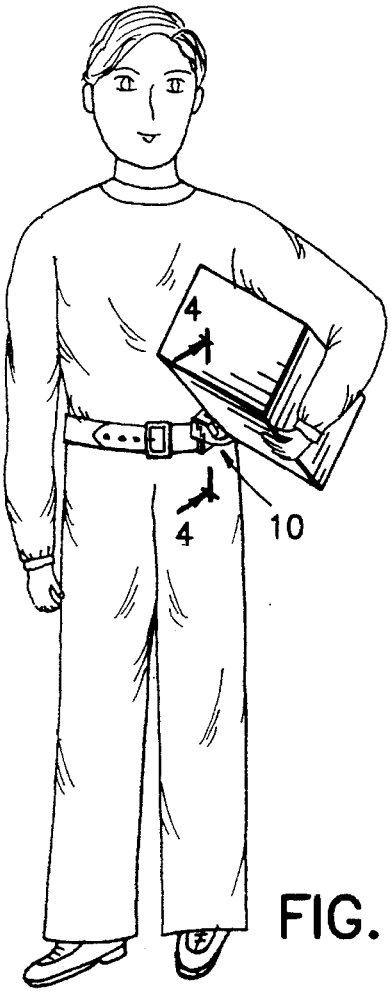
FIG. 1 is a pictorial view of a person shown wearing the device and carrying a box-like structure rotated approximately 45 degrees from the vertical.

The box-like holder and carrier of the instant invention is shown generally at 10 and is adapted to be secured to a person for instance by means of a belt or waistband of pants as best seen in FIG. 1.

Figure 2:
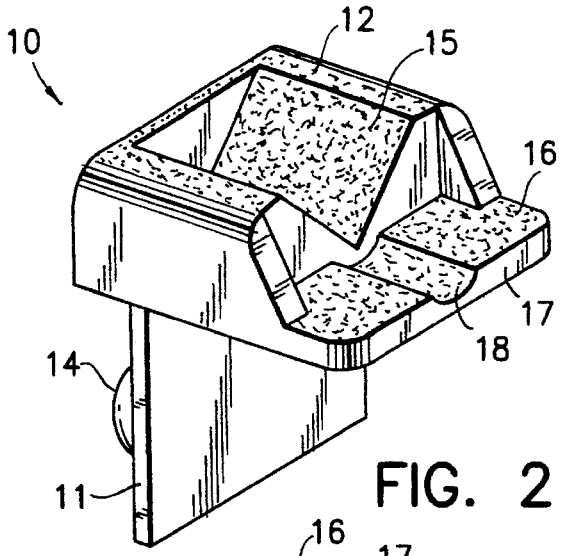
FIG. 2 is a pictorial of essentially a front view of the invention.
Figure 3:
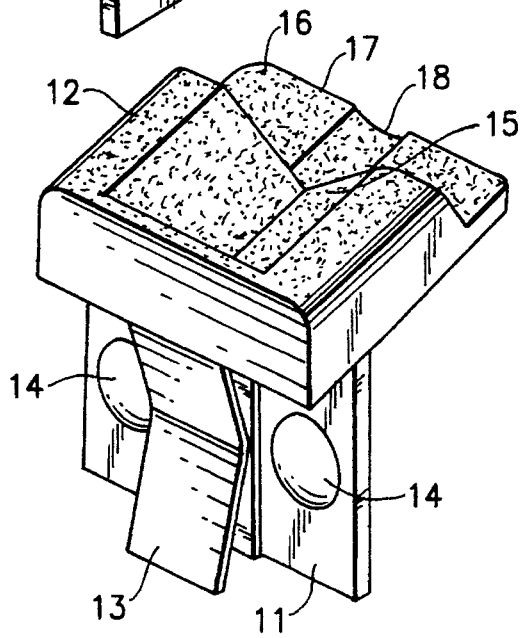
FIG. 3 is a pictorial of essentially a rear view of the invention.
Figure 4:
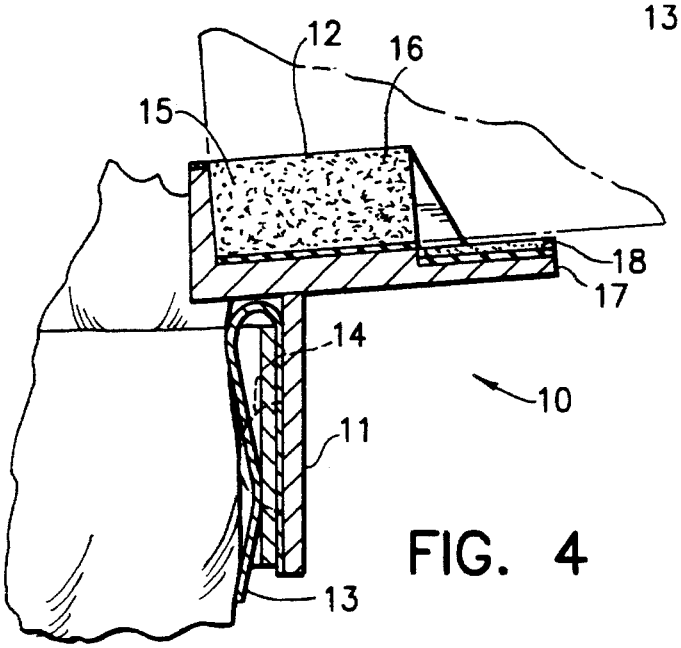
FIG. 4 is a cut off section of a side view of the invention.

The basic box-like holder and carrier 10 comprises a vertical portion 11 and a horizontal shelf 12 disposed at approximately 90 degrees from the vertical portion 11 as clearly seen in FIGS. 2 and 3. While one piece construction is shown and preferred the vertical and horizontal shelf portions may be two separate pieces and joined together by any well known fastening means. Further, the vertical portion 11 can be joined to the bottom of the horizontal shelf 12 either at their edges or in a somewhat "T" fashion as shown in the figures.

The vertical portion 11 has attached to it, by any well known means, a clip 13, which may be a spring loaded clip, for securing the box-like holder - carrier of the invention to a person as shown in FIG. 1. The clip can attach the device to a belt, waistband, or the like of a person who will be carrying the heavy boxes upstairs or ladders or the like.

Disposed on the vertical portion 11 on either side of the clip 13, are pads 14 for cushioning the device against the person when a heavy box is placed on the horizontal shelf. These pads are preferably of dense, soft rubber molded construction but other suitable materials may be used. While the carrier-holder of the invention can clearly function without pads 14, they are preferred.

As seen in FIGS. 2 and 3 a generally "V" shaped notch 15 is formed in the horizontal shelf 12 to accommodate two adjacent sides of a box-like structure as seen in FIG. 1. With the box resting in the "V" shaped notch the weight of such box is generally off the arms and hands of the person and is distributed rather to the persons torso. The persons arms and hands are therefore free to perform other functions such as grabbing the rungs of a ladder, handrails of a staircase, or to push an elevator button, etc.

A non-skid material such as shown at 16 can be placed on the upper surfaces of the horizontal shelf to help prevent the box from slipping out of the "V" shaped notch.

Extending horizontally outwardly of horizontal shelf 12 is a ledge 17 having a generally semi-circular notch 18 formed therein for accommodating and carrying other objects, for example the corners of heavy plate glass windows and the like. It is anticipated that when using this ledge 17 and notch 18 two persons would be used with each having the box like carrier of the invention secured to their person. Each person would have one edge of such object, such as a plate glass window, disposed in the notch 18 of ledge 17 of his or her carrier-holder.

Though the invention has been described and illustrated with reference to a preferred embodiment thereof, those skilled in the art will appreciate that various changes and modifications in shape, size composition and arrangement of parts may be resorted to without departing from the spirit of the invention or scope of the subjoined claims.

What is claimed is:

1. A box holder and carrier of the type to be attached to a person for assisting in holding carrying box-like structures comprising:

(a) a vertical planar portion;

(b) a horizontal shelf portion having a rigid top surface disposed at substantially 90 degrees from said vertical planar portion;

(c) means for securing said box holder and carrier to a person in a standing position such that said shelf portion extends horizontally and laterally of said person; and (d) a "V" shape notch disposed in said top surface and extending in a direction normal to said vertical planar portion for receiving adjacent sides of a box-like structure thereagainst whereby said box-like structure is supported by said box holder and carrier.

2. The device of claim 1 wherein said means for securing said box holder and carrier to a person is a clip for attachment to a belt or waist band of said person.

3. The device of claim 1 and 2 wherein non-skid material is placed on said top surface of said horizontal shelf portion to help prevent said box-like structure from slipping.

4. The device of claim 3 wherein cushioning pads are disposed on said vertical portion for cushioning said box holder and carrier against said person when said box-like structure is disposed in said "V" shaped notch and such device is being worn by such person.

* * * * *